US009121400B1

(12) United States Patent
Myers

(10) Patent No.: US 9,121,400 B1
(45) Date of Patent: Sep. 1, 2015

(54) HIGH VOLUME DUAL DIAPHRAGM PUMP WITH VACUUM RELIEF

(71) Applicant: Douglas D. Myers, Jacksonville, FL (US)

(72) Inventor: Douglas D. Myers, Jacksonville, FL (US)

( * ) Notice: Subject to any disclaimer, the term of this patent is extended or adjusted under 35 U.S.C. 154(b) by 0 days.

(21) Appl. No.: 14/477,841

(22) Filed: Sep. 4, 2014

(51) Int. Cl.

| | |
|---|---|
| ***F04B 49/22*** | (2006.01) |
| ***F04B 43/02*** | (2006.01) |
| ***F04B 53/10*** | (2006.01) |
| ***F04B 53/22*** | (2006.01) |

(52) U.S. Cl.
CPC ..... *F04B 43/026* (2013.01); *F04B 49/22* (2013.01); *F04B 53/1047* (2013.01); *F04B 53/22* (2013.01)

(58) Field of Classification Search
CPC ..... F04B 17/05; F04B 35/002; F04B 43/02; F04B 43/025; F04B 43/026; F04B 39/1086
USPC ..... 417/34, 234, 364, 412, 413.1, 435, 440; 137/526, 527.8, 855, 858
See application file for complete search history.

(56) References Cited

U.S. PATENT DOCUMENTS

| | | | | |
|---|---|---|---|---|
| 1,891,408 | A * | 12/1932 | Gorman | 417/566 |
| 2,157,132 | A * | 5/1939 | Joy | 417/321 |
| 2,572,263 | A * | 10/1951 | Hofer | 37/311 |
| 4,963,075 | A * | 10/1990 | Albertson et al. | 417/273 |
| 2006/0112480 | A1 * | 6/2006 | Sisk | 4/507 |
| 2011/0068285 | A1 * | 3/2011 | Rief et al. | 251/63.4 |

* cited by examiner

*Primary Examiner* — Charles Freay
*Assistant Examiner* — Philip Stimpert
(74) *Attorney, Agent, or Firm* — Mark Young, P.A.

(57) ABSTRACT

A double diaphragm pump for moving large volumes of water that may be laden with debris includes a pair of fourteen-inch diameter elastomeric diaphragms, driven by reciprocating push rods pivotally coupled to opposed eccentrics. An engine drives a gearbox having two outputs. One eccentric is attached to each output. A pair of weighted flap valves control flow to and from each diaphragm chamber. A vacuum pressure gauge monitors inlet pressure. A relief valve relieves vacuum pressure in the event of a blockage or other flow impediment.

17 Claims, 25 Drawing Sheets

HIGH VOLUME DUAL DIAPHRAGM PUMP WITH VACUUM RELIEF

FIELD OF THE INVENTION

This invention relates generally to pumps, and, more particularly, to a high volume pump with 180 degree offset diaphragms, and an inlet with a vacuum relief valve.

BACKGROUND

Diaphragm pumps are useful for transferring large volumes of water for agricultural, construction and marine industries among others. Such pumps may efficiently transfer even mud-laden water. Typically, such pumps comprise an elastomeric diaphragm driven by a pushrod or fluctuating pressure.

Heretofore, diaphragm pumps for construction have been limited in size to avoid excessive pressure. A large diameter pump may collapse and irreparably damage a hose if debris impedes flow through the hose. After the hose collapses, the elastomeric diaphragm experiences a pressure spike with considerable attendant stresses and strains, which may compromise the integrity or useful life of the diaphragm. Affected components may warp. Seals around the pump may fail under the increased pressures experienced during a collapse.

To avoid such problems, most prior art pumps limit diaphragm size to below 12 inches in diameter. Such size limitations avoid the pressures that can harm hoses, the diaphragms and seals. However, such pumps achieve limited volumetric flow rates.

What is needed is a large diameter diaphragm pump, that is capable of transferring large volumes of water, including water laden with mud and debris, and is responsive to flow blockages. The pump should include diaphragms having a radius greater than 6 inches and means to prevent excessive pressure differentials that could damage diaphragms, hoses and seals.

The invention is directed to overcoming one or more of the problems and solving one or more of the needs as set forth above.

SUMMARY OF THE INVENTION

To solve one or more of the problems set forth above, in an exemplary implementation of the invention, a double diaphragm pump for moving large volumes of water that may be laden with debris is provided. The pump includes a pair of 12 to 16-inch (preferably 14 to 14.5 inch) diameter elastomeric diaphragms, driven by reciprocating push rods pivotally coupled to opposed eccentrics. An engine drives a gearbox having two outputs. One eccentric is attached to each output. A pair of weighted flap valves controls flow to and from each diaphragm chamber. A vacuum pressure gauge monitors inlet suction pressure. A vacuum relief valve relieves pressure in the event of a blockage or other flow impediment.

In one embodiment, an exemplary double diaphragm pump according to principles of the invention includes a pair of diaphragm chambers; a pair of elastomeric diaphragms, including one elastomeric diaphragm attached to each diaphragm chamber, each elastomeric diaphragm having a radius of at least 6 inches, and each diaphragm chamber having a width of at least 11.00 inches. A pair of inlet valves, including an inlet valve for each diaphragm chamber, control the flow of fluid into the diaphragm chamber. A pair of outlet valves, including an outlet valve for each diaphragm chamber, control the flow of fluid from each diaphragm chamber.

An inlet fluidly is coupled to the inlet valve and fluidly coupled to the diaphragm chamber. Each inlet valve is disposed between its corresponding diaphragm chamber and the inlet.

To prevent pressure spikes, a vacuum relief valve is fluidly coupled to the inlet. The vacuum relief valve includes a valve mechanism opening at a set pressure condition (e.g., a reduced pressure in the inlet indicative of a flow impediment relative to ambient pressure), and an auxiliary port through which ambient air may flow into the inlet when the valve mechanism opens. In one embodiment, the valve, may, optionally, include a manual actuator to manually open the valve mechanism. Spring tension or compression in the valve mechanism may be adjusted using an adjuster, such as a threaded adjuster (e.g., screw), thereby adjusting or regulating the set pressure.

An inlet manifold, which may comprise a plurality of interconnected channels and flow paths, leads from the inlet to each diaphragm chamber. Thus, each diaphragm chamber is fluidly coupled to the inlet manifold and each inlet valve is disposed in the inlet manifold (e.g., at the interface between the inlet manifold and the chambers).

Being a high volume pump, each elastomeric diaphragm has a radius of 6.0 to 8.00 inches, preferably about 7.0 to 7.25 inches, for a diameter of about 14.0 to 14.50 inches.

Optionally, a vacuum pressure gauge is fluidly coupled to the inlet. In one embodiment, the gauge is directly coupled to the inlet. In another embodiment, the gauge is fluidly coupled to the vacuum relief valve, in fluid communication with the inlet. The vacuum pressure gauge may have a readable display indicating pressure within the inlet.

The exemplary pump is powered by an engine via a gearbox. The engine includes an output. The gearbox includes one input, two outputs and a gear train coupling the one input of the gearbox to the two outputs of the gearbox. The output of the engine is coupled to the input of the gearbox and rotates at 1,800 to 2,200 rpm during operation. Each output of the gearbox rotates (through reduction) at 60 to 80 rpm during operation.

An eccentric is attached to each output of the gear box. A pair of pushrods is provided. Each pushrod has a first end and a second end. The first end of each pushrod is coupled to one of the eccentrics. The second end of each pushrod is coupled to one of the diaphragms. The pushrods are driven in reciprocating motion by rotation of eccentrics. The reciprocating motion is between a first position closest to the diaphragm to which the pushrod is coupled, and a second position furthest from the diaphragm to which the pushrod is coupled. Reciprocating motion of the pushrods causes compression and suction motion of the diaphragms. Each eccentric is 180° apart, such that one pushrod is in a first position when the other pushrod is in a second position.

Each of the pair of inlet valves and outlet valves may be a one-way flap check valve including a resilient elastomeric flap covering an opening in an inlet or outlet horizontal wall when closed and exposing the opening when opened. A weight may be provided on each resilient flap to facilitate closure.

The pump may include various access and clean-out panels and ports. For example, a removable access panel may be provided over each of the pair of outlet valves. Each such access panel is removable secured with a plurality of bolts (e.g., 4 or more bolts) to prevent leakage under high outlet pressure. A gasket is provided for a fluid impervious seal.

The double diaphragm pump according to principles of the invention may be mounted on a trailer for transportation.

BRIEF DESCRIPTION OF THE DRAWINGS

The foregoing and other aspects, objects, features and advantages of the invention will become better understood with reference to the following description, appended claims, and accompanying drawings, where:

Figure 1:
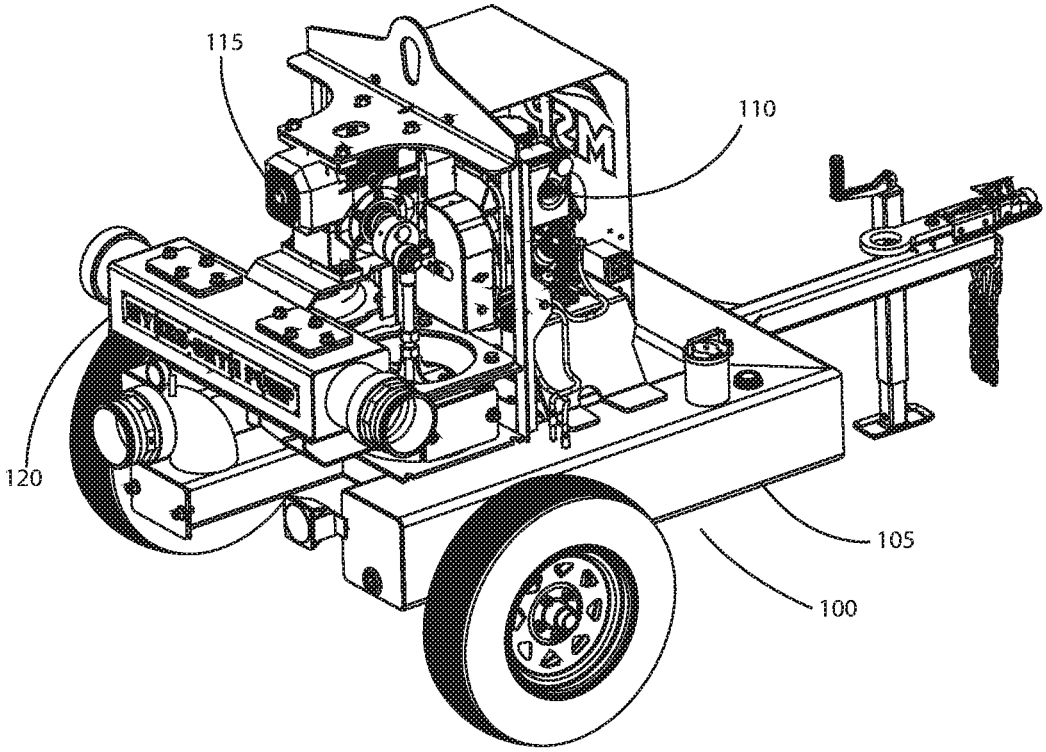
FIG. 1 is a perspective view of an exemplary diaphragm pumping system according to principles of the invention.
Figure 2:
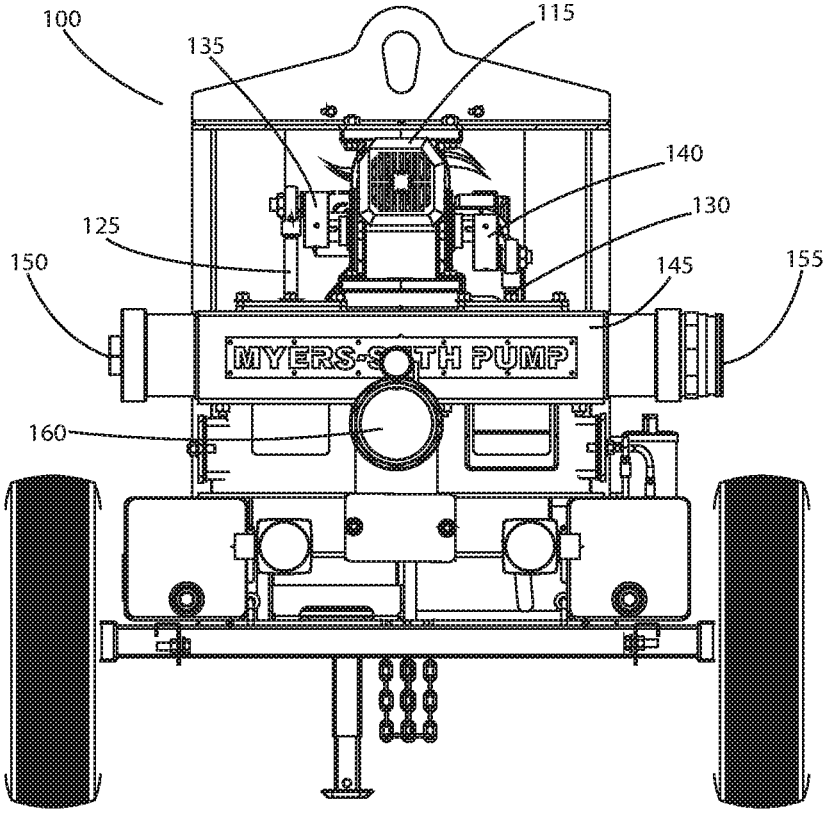
FIG. 2 is a front view of an exemplary diaphragm pumping system according to principles of the invention.
Figure 3:
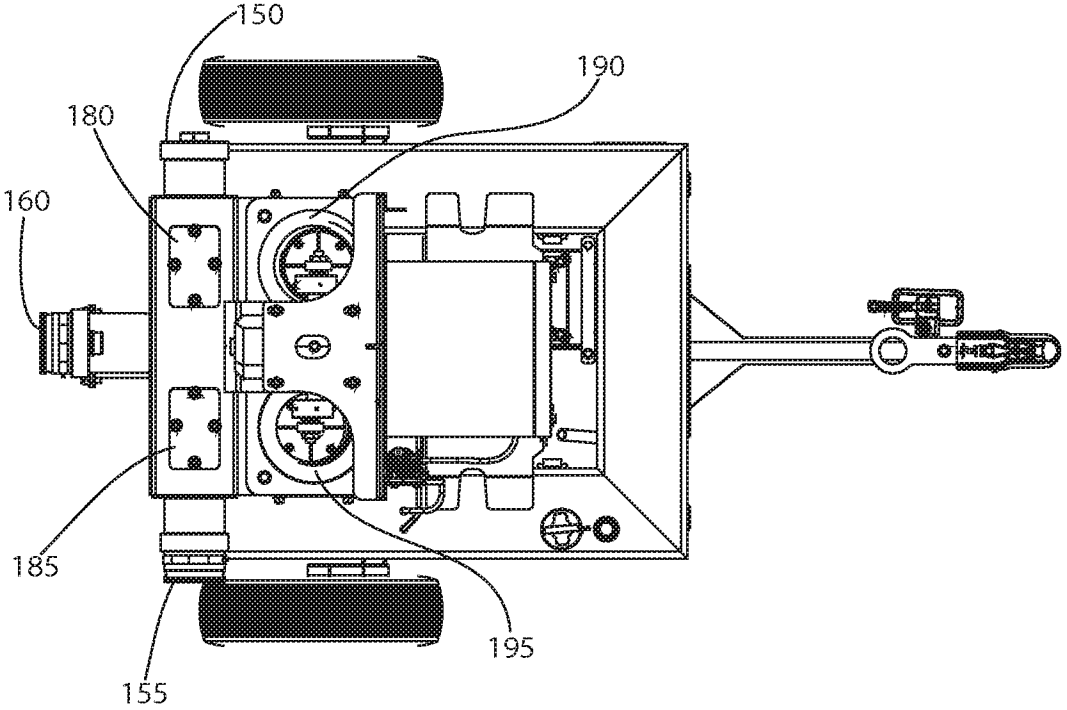
FIG. 3 is a plan view of an exemplary diaphragm pumping system according to principles of the invention.
Figure 4:
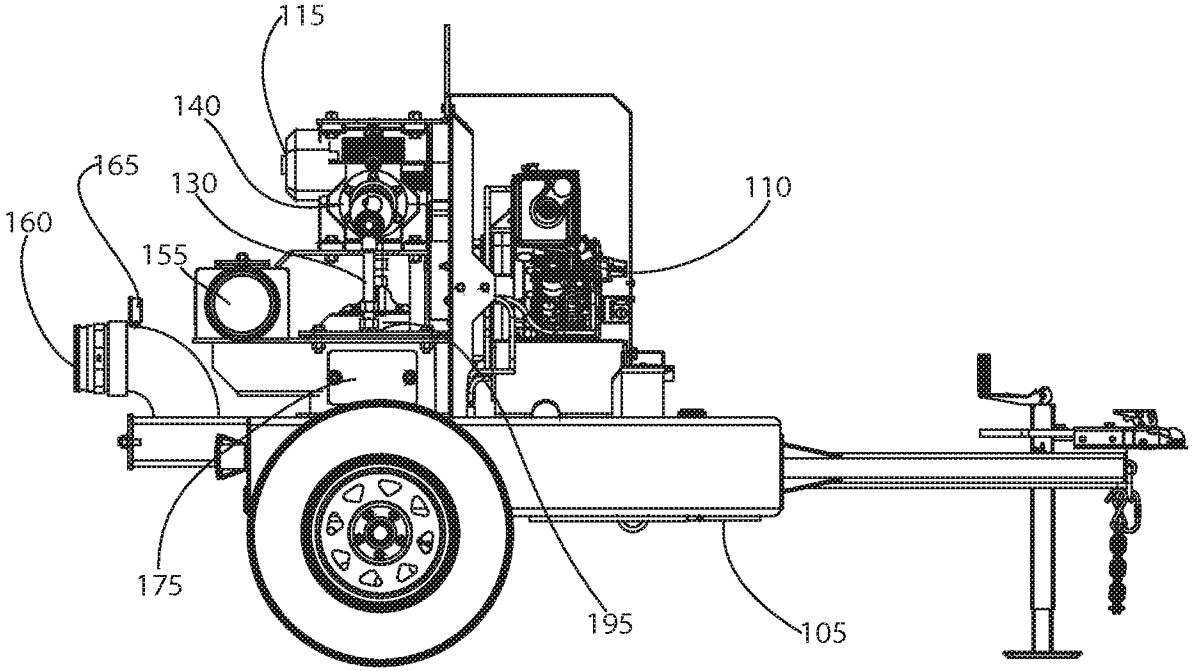
FIG. 4 is a side view of an exemplary diaphragm pumping system according to principles of the invention.
Figure 5:
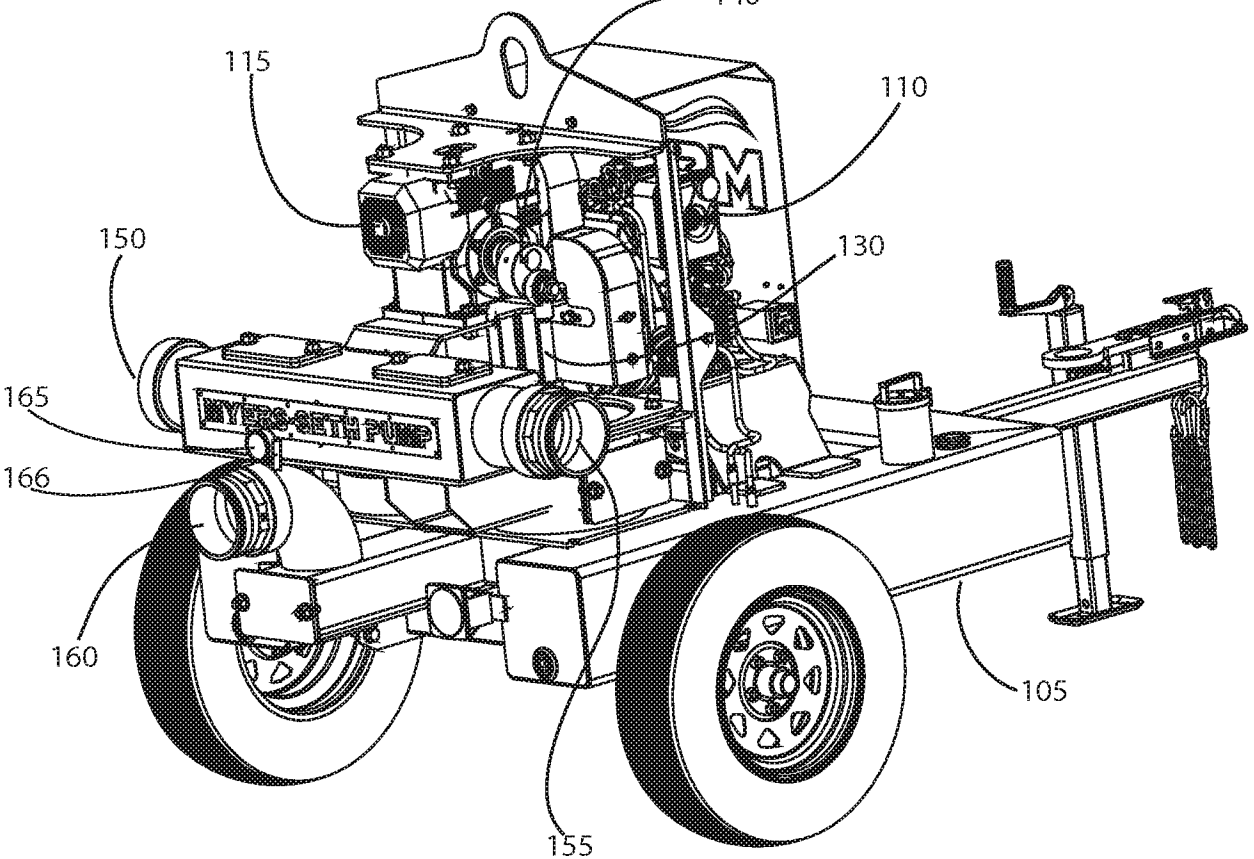
FIG. 5 is a first perspective view of an exemplary diaphragm pumping system according to principles of the invention.
Figure 6:
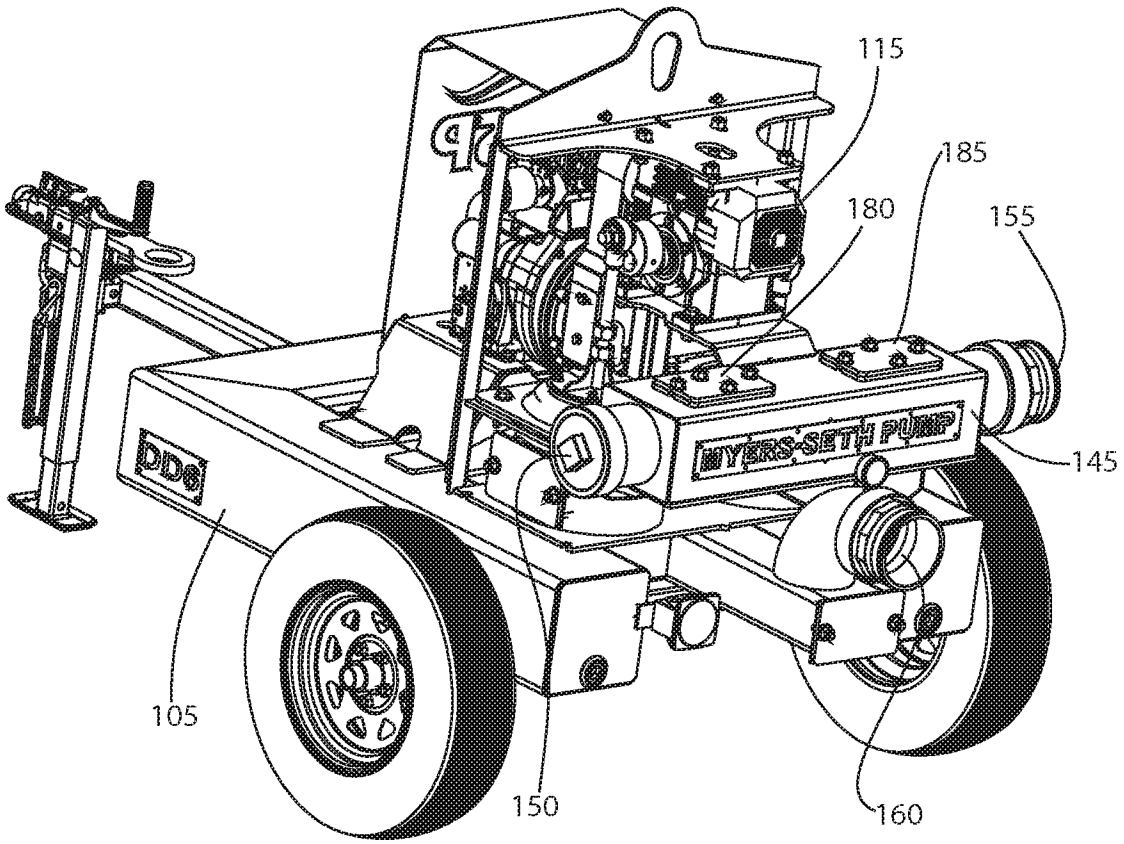
FIG. 6 is a second perspective view of an exemplary diaphragm pumping system according to principles of the invention.
Figure 7:
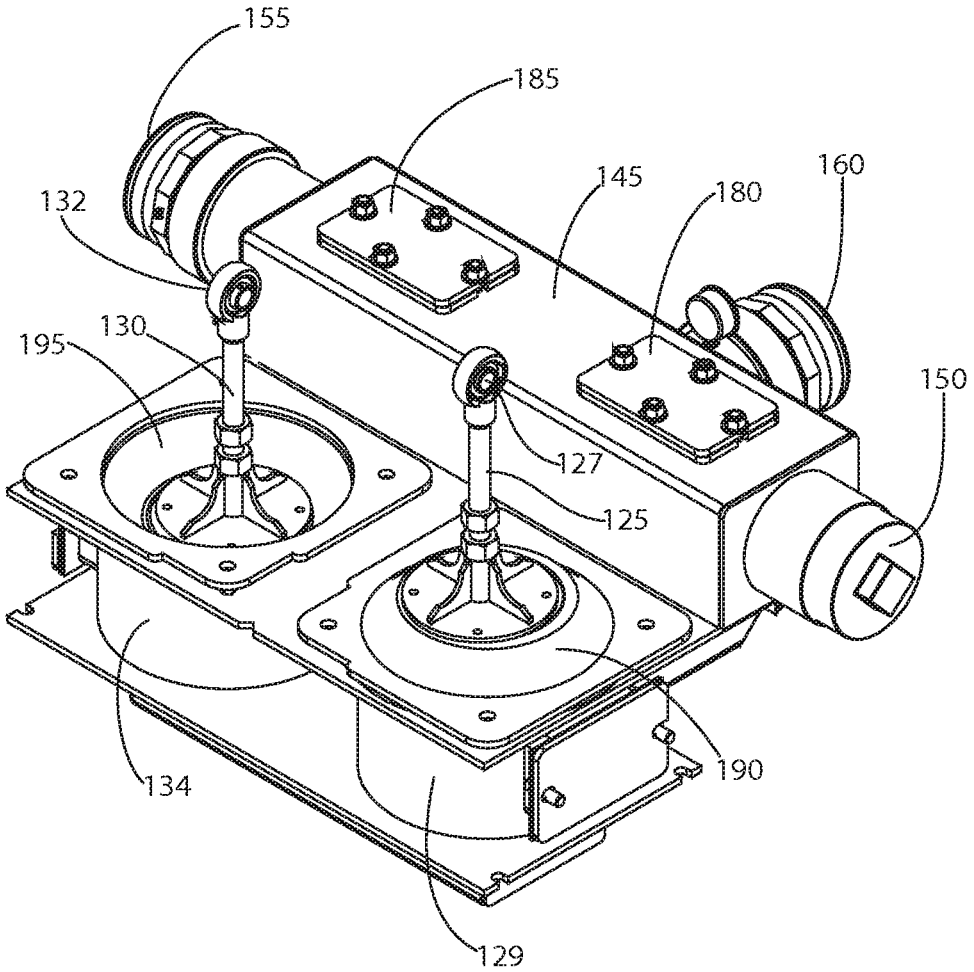
FIG. 7 is a first perspective view of an exemplary diaphragm pumping mechanism according to principles of the invention.
Figure 8:
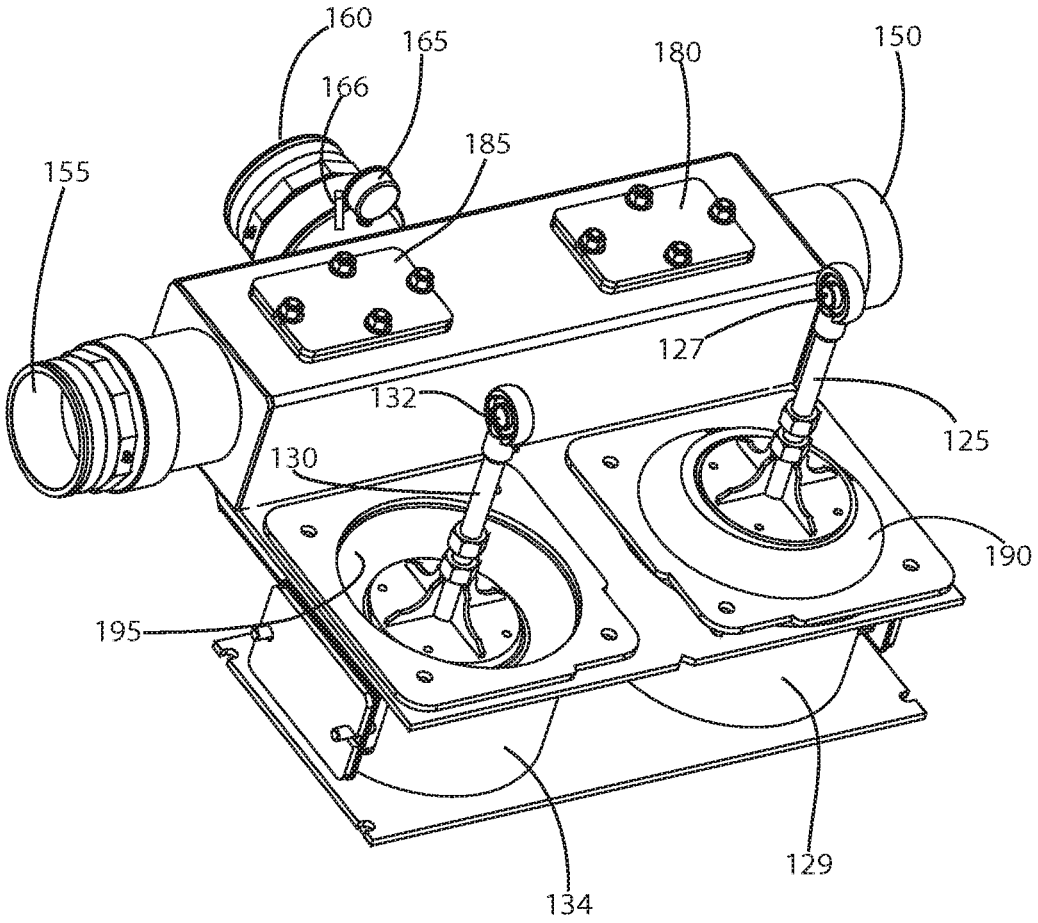
FIG. 8 is a second perspective view of an exemplary diaphragm pumping mechanism according to principles of the invention.
Figure 9:
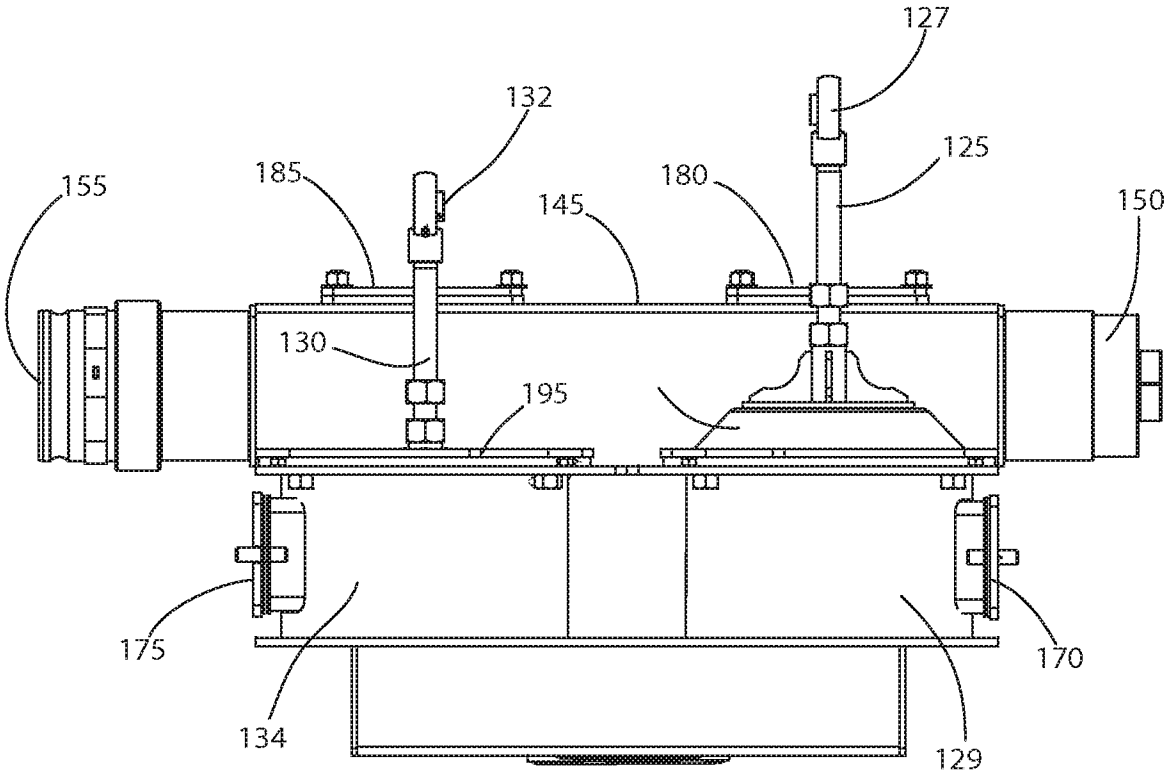
FIG. 9 is a back view of an exemplary diaphragm pumping mechanism according to principles of the invention.
Figure 10:
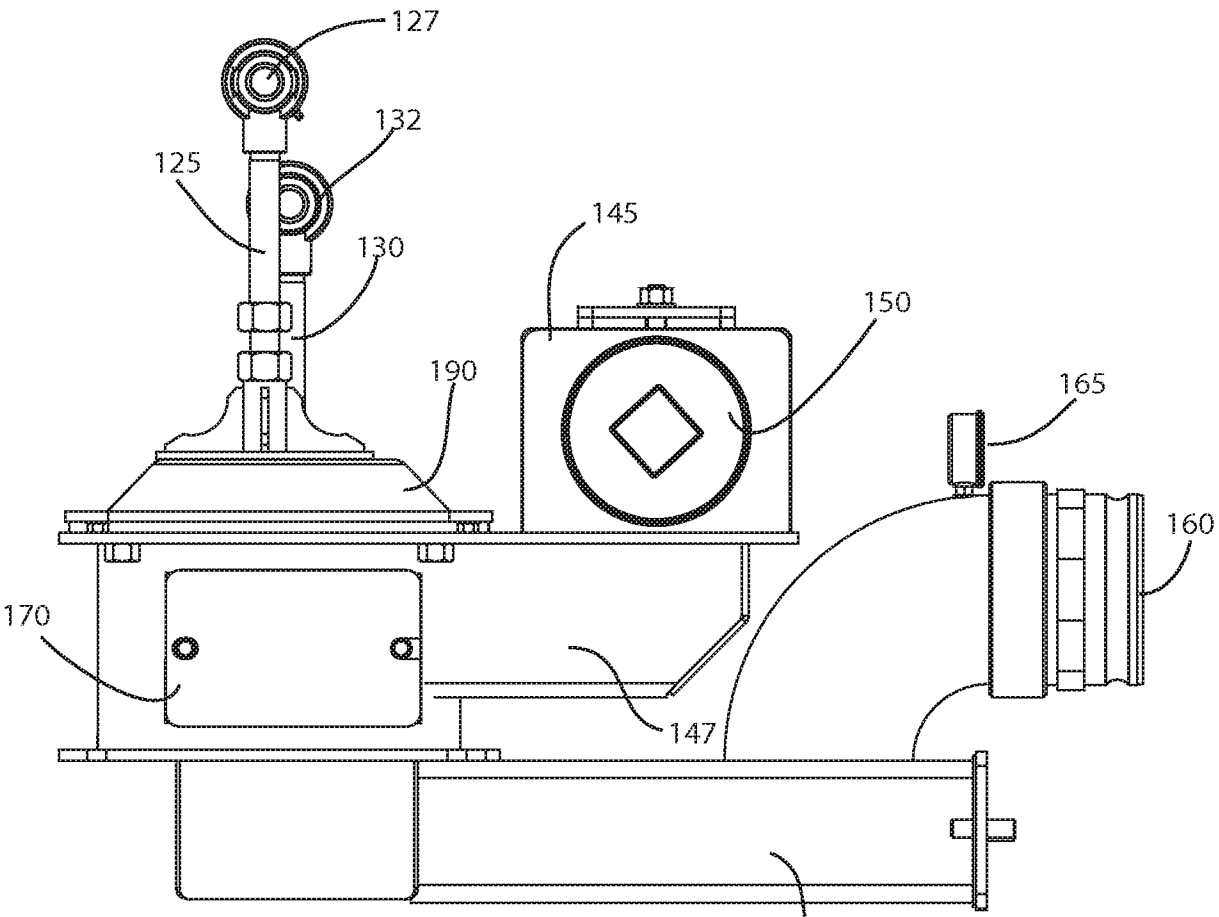
FIG. 10 is a side view of an exemplary diaphragm pumping mechanism according to principles of the invention.
Figure 11:
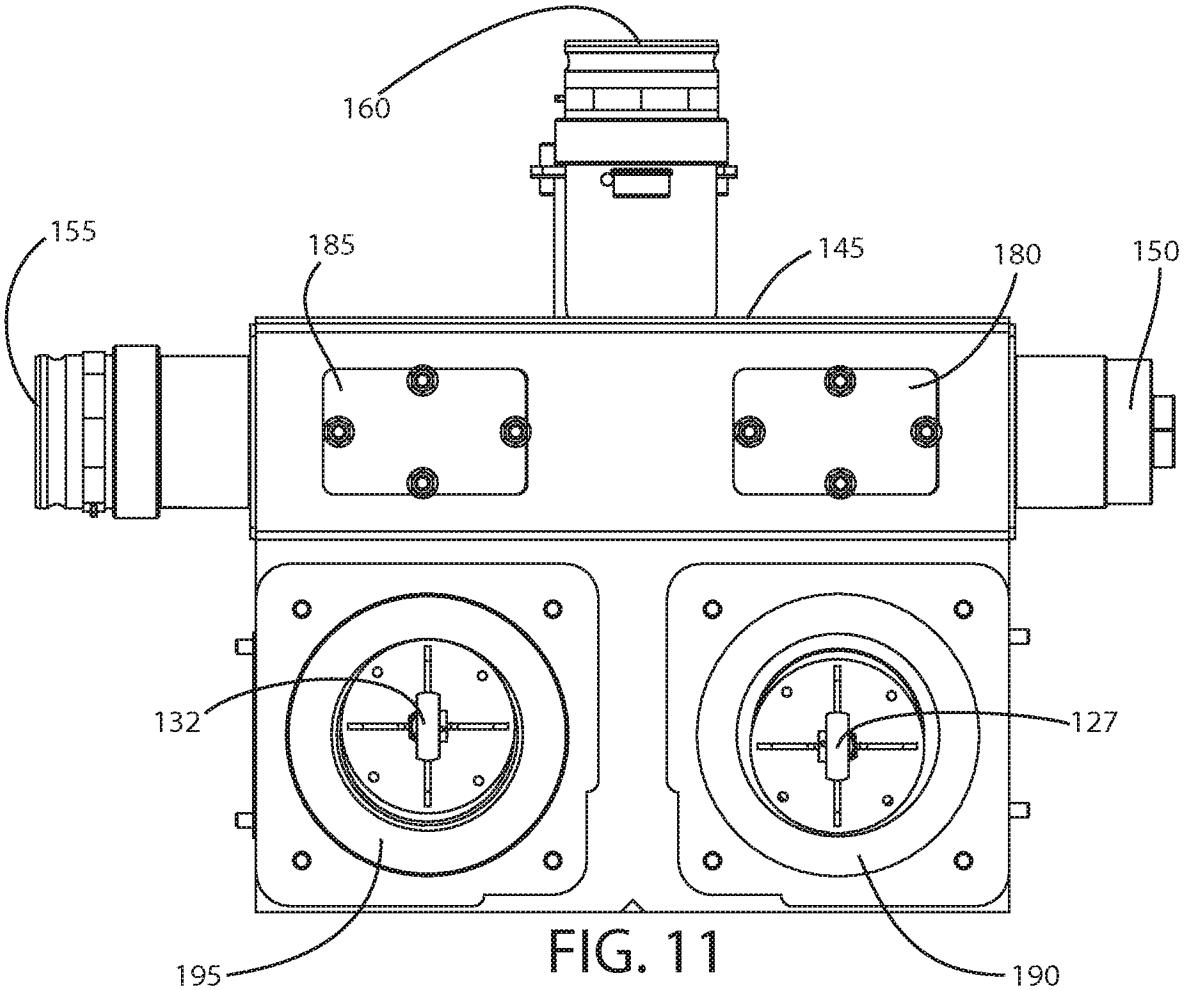
FIG. 11 is a plan view of an exemplary diaphragm pumping mechanism according to principles of the invention.
Figure 12:
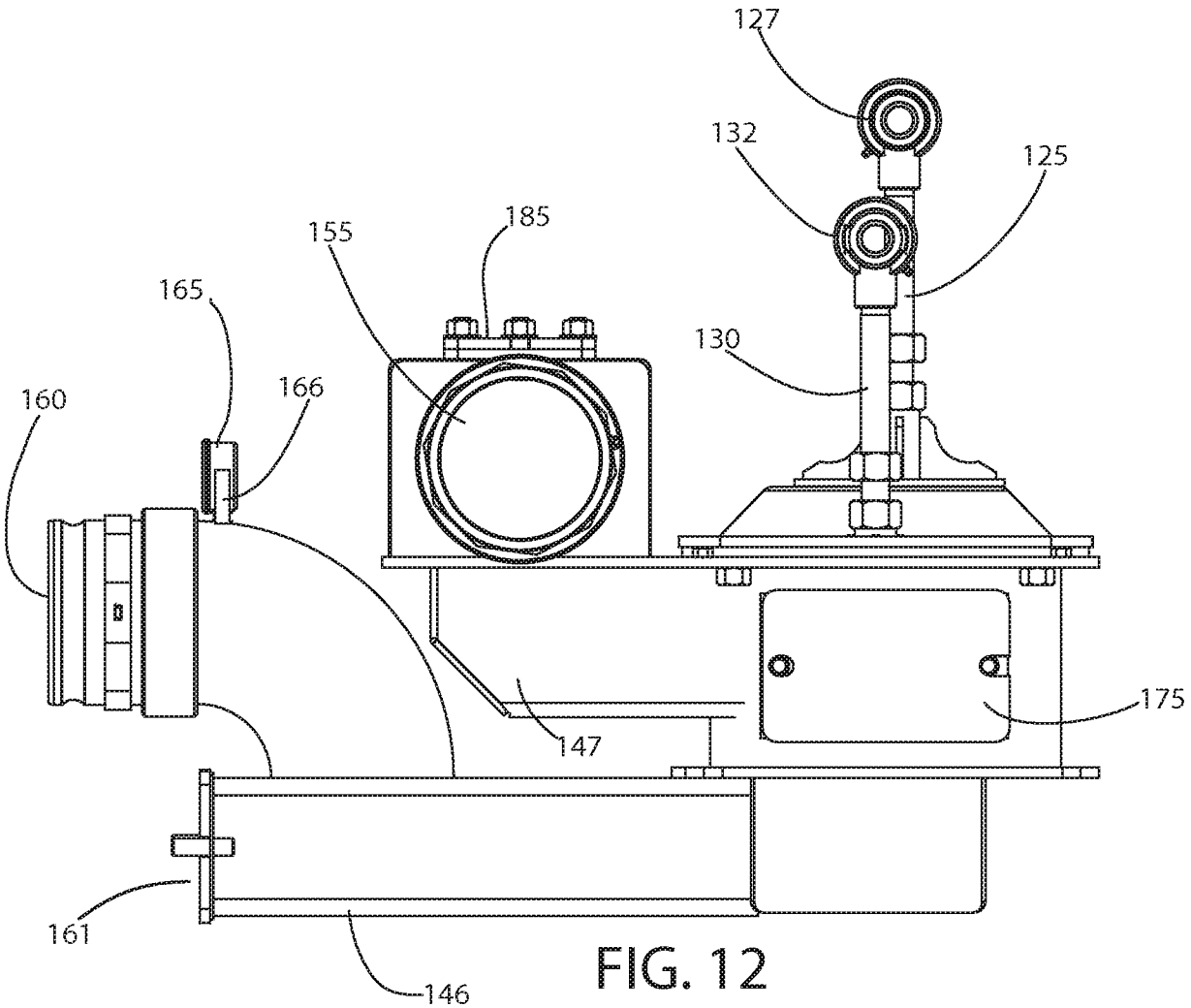
FIG. 12 is a front view of an exemplary diaphragm pumping mechanism according to principles of the invention.
Figure 13:
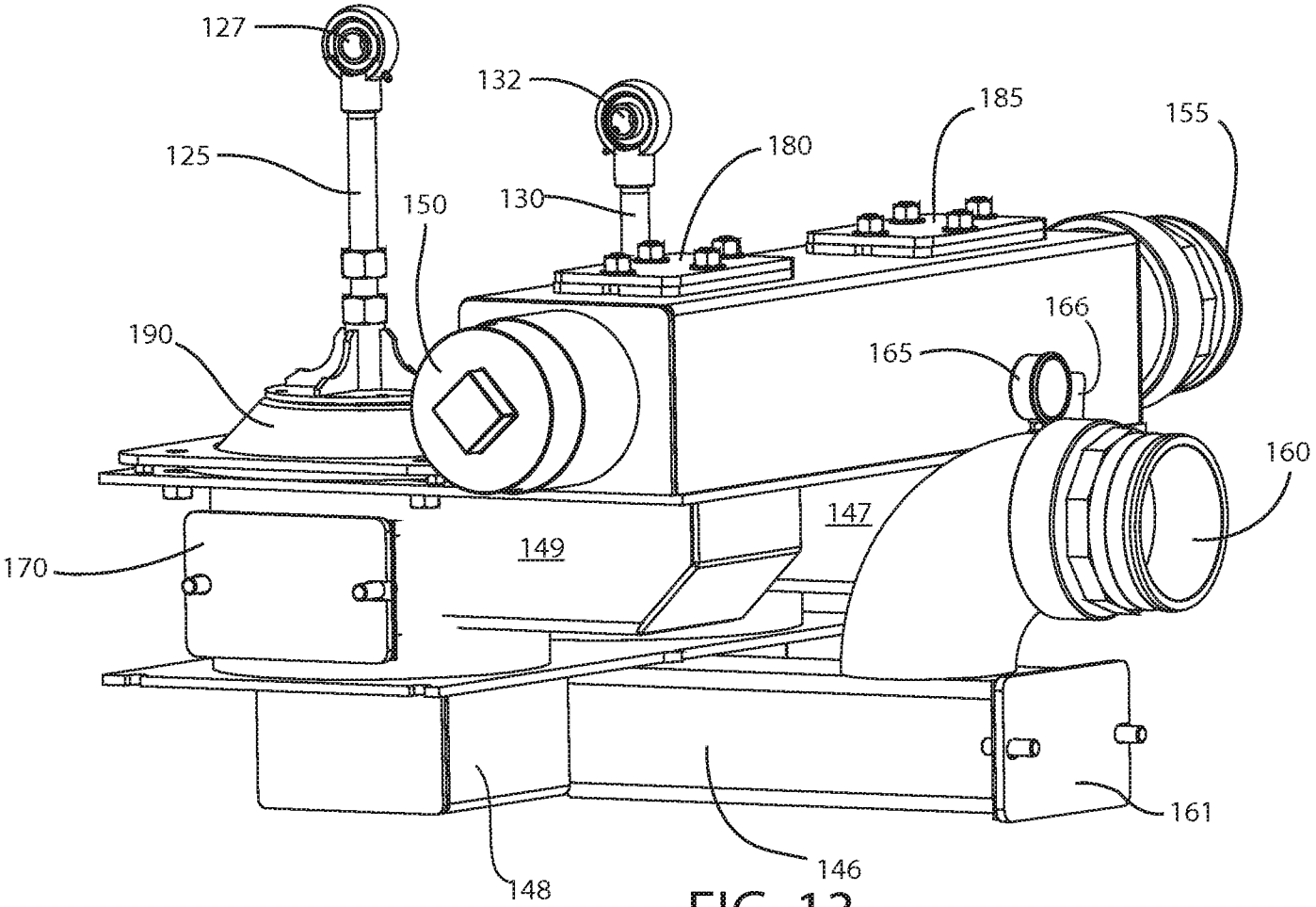
FIG. 13 is a first perspective view of an exemplary diaphragm pumping mechanism according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Referring to FIGS. 1 through 6, various views of an exemplary diaphragm pumping system 100 according to principles of the invention is conceptually illustrated. The system comprises a pumping mechanism 120 on a trailer 105. A motor or engine, such as a diesel engine 110 (e.g., a 5.7 hp Hatz diesel engine at about 2000 rpm), drives an input of a transmission (e.g., gearbox 115) having two rotating outputs with eccentrics 135, 140. A push rod 125, 130 couples each eccentric 135, 140 to a diaphragm 190, 195. Each push rod 125, 130 may have a fixed length or a variable length to adjust the stroke. The pumping mechanism 120 includes an inlet 160 and an outlet chamber 145 with a pair of opposed outlet ports 150, 155, one of the outlet ports 150 being shown capped (i.e., closed) and the other being shown open 155. A user may select which outlet port to use. Various access ports 170, 175, 180, 185 enable access for cleaning chambers and maintaining valves. While the exemplary embodiment includes a trailer 105, the invention is not limited to trailer-mounted pumping mechanisms.

Various chambers, manifolds, inlets and outlets are shown in FIGS. 7-14. The exemplary pumping mechanism 120 comprises a positive displacement diaphragm pump that uses a combination of the reciprocating action of a pair of elastomeric diaphragms 190, 195 and suitable valves (e.g., check valve, butterfly valves, flap valves, or any other form of shut-off valves) to pump a fluid. The diaphragms 190, 195 flex, causing the volume of each pump chamber 129, 134 (FIG. 7) to increase and decrease. When a diaphragm flexes (upwardly) to increase the volume of a pump chamber 129, 134, pressure decreases and fluid is drawn into the pump chamber through the inlet 160, an inlet chamber 146 and a manifold 148 coupling the inlet 160 to each pump chamber 129, 134. When a diaphragm flexes (downwardly) to decrease the volume of a pump chamber 129, 134, pressure increases and fluid is expelled from the pump chamber through an outlet manifold 147 to an outlet chamber 145 and through whichever outlet 150, 155 is open. The pumping mechanism 120 is configured with the eccentrics 135, 140 180° apart. Thus, one diaphragm flexes upwardly while the other diaphragm flexes downwardly, and vice versa. This pumping action repeats cyclically, similar to that of the cylinders in an internal combustion engine.

Each eccentric 135, 140 is a disk (eccentric sheave) attached to a rotating output axle of the gear box 115. Each push rod 125, 130 terminates with a bearing 127, 132. Each bearing 127, 132 pivotally attaches to the eccentric sheave 135, 140, off-center. The push rods 125, 130 impart reciprocating motion to the diaphragms 190, 195. Thus, the eccentrics 135, 140 and push rods 125, 130 convert rotary into linear reciprocating motion in order to drive the diaphragms 190, 195.

Referring now to FIGS. 23 through 28, various views of an exemplary diaphragm, in an un-deformed state (FIGS. 23, 24), a flexed downwardly state for expelling fluid (FIGS. 25, 26), and a flexed upwardly state for drawing in fluid (FIGS. 27, 28), for an exemplary diaphragm pumping mechanism according to principles of the invention, are provided. The diameter, d, of the diaphragm 190 is from 12 to 16 inches, preferably about 14 to 15 inches, and more preferably about 14 to 14.5 inches. The pushrods 125, 130 driven by the rotating eccentrics 135, 140 provide a stroke effective for pumping. The stroke length cannot exceed the depth of the diaphragm chamber or the maximum tensile stress of the diaphragm. In an exemplary embodiment, the stroke length is about 7-inches, including 3.5 inches downwardly from the at-rest position for the expelling portion of the stroke, $h_1$ in FIGS. 25, and 3.5 inches upwardly from the at-rest position for the drawing-in portion of the stroke, $h_2$ in FIG. 27. The diaphragm 190 includes a flanged outer periphery 191 for securing the diaphragm over a diaphragm chamber using an annular bolt-on clamp. A flanged inner periphery 193 is secured to a disk-shaped flange coupled to the pushrods 125, 130. The portion 192 of the diaphragm 190 between the outer 191 and inner 193 flanges is a portion that stretches during pumping action.

To maintain a tight seal even under high pressure, in a preferred embodiment the access ports 180, 185 on the outlet chamber 145 include panels secured with four or more attachments (e.g., bolts). These ports 180, 185 are exposed to high positive pressure pushing outwardly on the panel, while ports 170, 175 on the inlet side experience a negative pressure drawing the panel inwardly. A gasket may be provided between the panel and each corresponding port 170, 175, 180, 185 to ensure a hermetic seal.

As shown in FIGS. 15 through 18, check valves (e.g., flap valves) control flow into and from the pump chambers 129, 134. In the particular non-limiting embodiment shown, a pair of non-return check valves 191, 196 yield to inward flow from the inlet 160 into the pump chambers 129, 134, while preventing reverse flow of the pumped fluid from the pump chambers 129, 134 to the inlet 160. Likewise, a pair of non-return check valves 181, 186 yield to outward flow from the pump chambers 129, 134, while preventing reverse flow of the pumped fluid from the outlet chamber 145 into the pump chambers 129, 134.

The gear box 115 serves as a transmission. It includes an input (e.g., a shaft) rotated by an output (e.g., flywheel or shaft) of the engine 110. A speed and torque-converting gear train in the gear box reduces rotations from the input (i.e., at about 1,800 to 2,200 rpm) to about 60 to 80 rpm at output shafts, to which the eccentrics 135, 140 are attached. In the exemplary embodiment depicted in the figures, the output shafts of the gearbox 115 are orthogonal to the input shaft of the gearbox 115. A non-limiting example of a suitable gear box is a Wormaster series gear box by Renold plc of Manchester, England.

Figure 14:
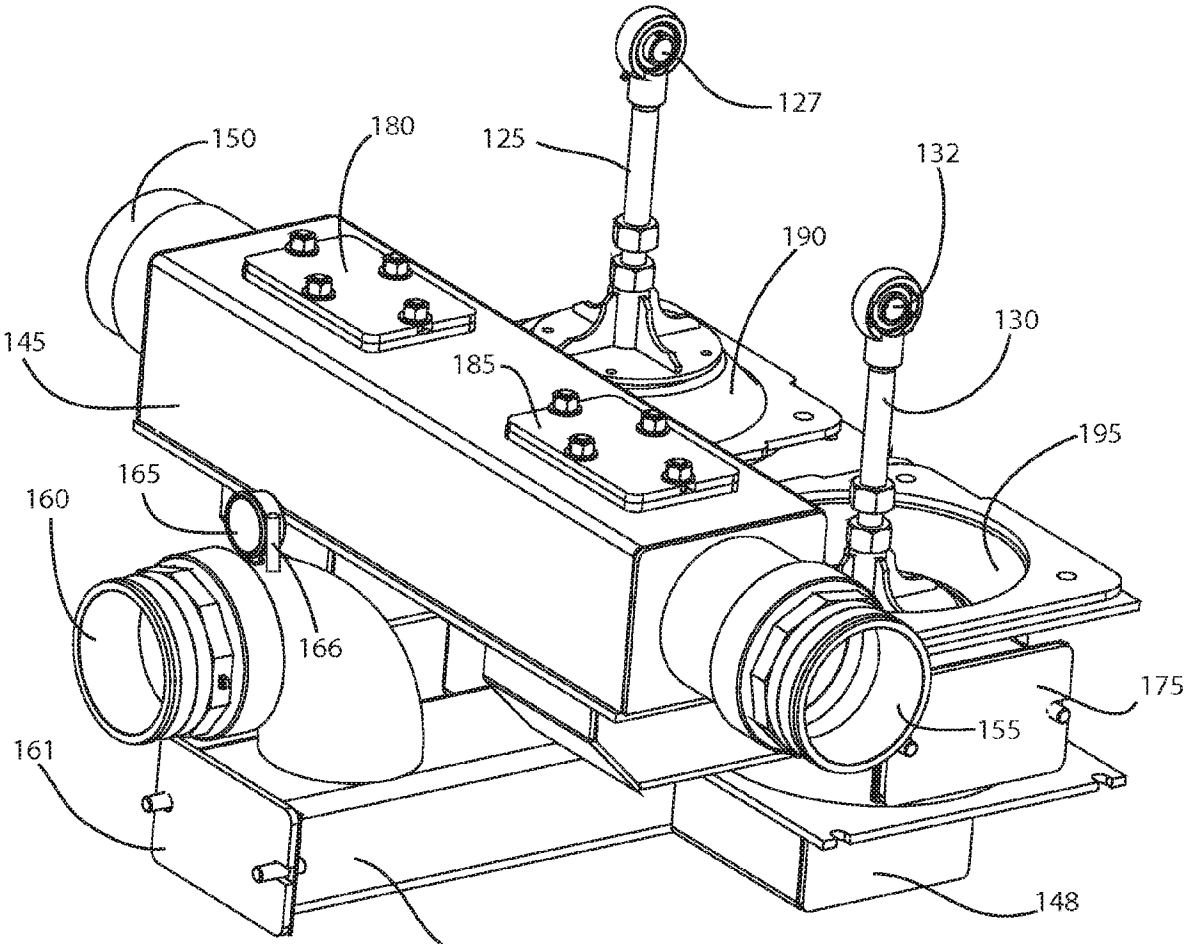
FIG. 14 is a second perspective view of an exemplary diaphragm pumping mechanism according to principles of the invention.
Figure 15:
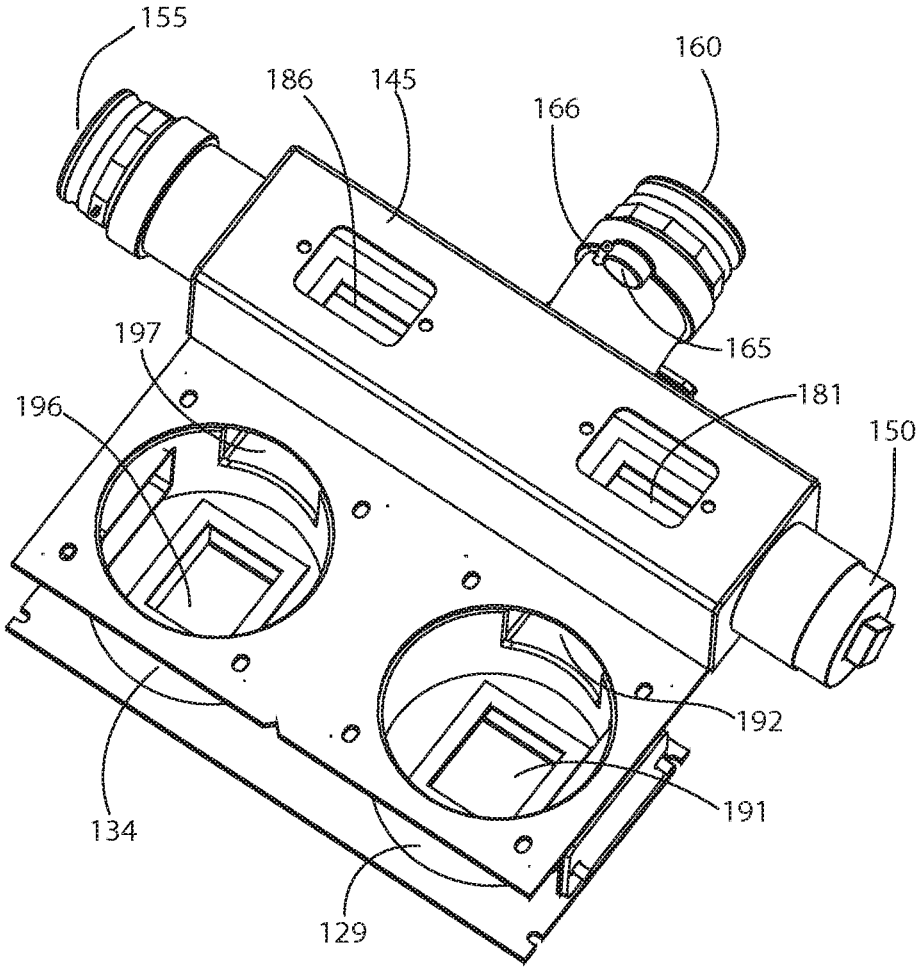
FIG. 15 is a perspective view of chambers of an exemplary diaphragm pumping mechanism according to principles of the invention.
Figure 19:
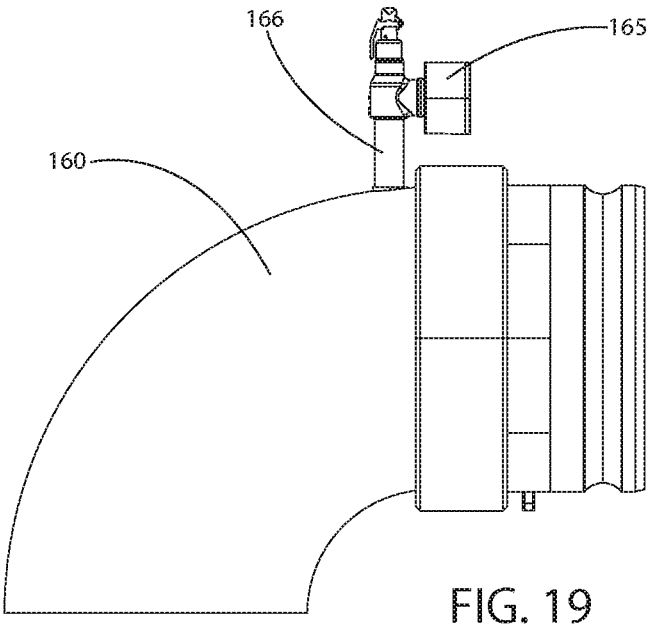
FIG. 19 is a side view of an inlet port of an exemplary diaphragm pumping mechanism according to principles of the invention.
Figure 20:
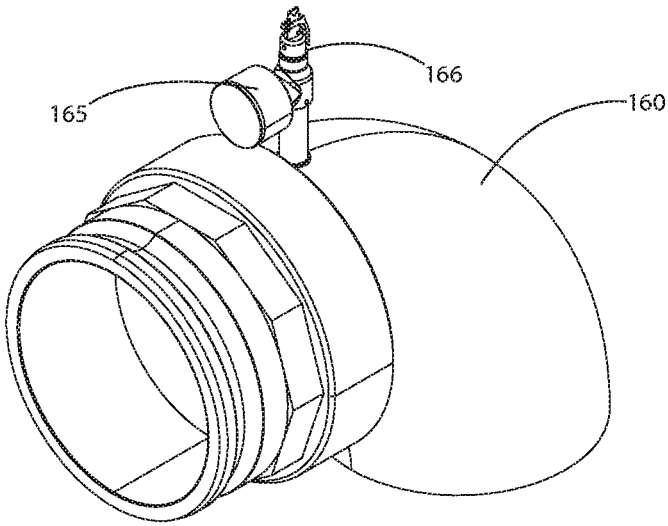
FIG. 20 is a perspective view of an inlet port of an exemplary diaphragm pumping mechanism according to principles of the invention.

In an exemplary embodiment, a vacuum pressure gauge 165 and vacuum relief valve 166 are fluidly coupled to the inlet 160. The vacuum pressure gauge 165 and vacuum relief valve 166 may be separate components, each of which is separately coupled to the inlet, as shown in FIG. 14, or coupled together as in FIGS. 19 and 20. The vacuum relief valve 166 may be used without the pressure gauge 165 or with the vacuum pressure gauge 165. The vacuum pressure gauge 165 and/or vacuum relief valve 166 may be fluidly coupled to the inlet 160, or to a chamber or manifold that is in fluid communication with the inlet 160.

Figure 21:
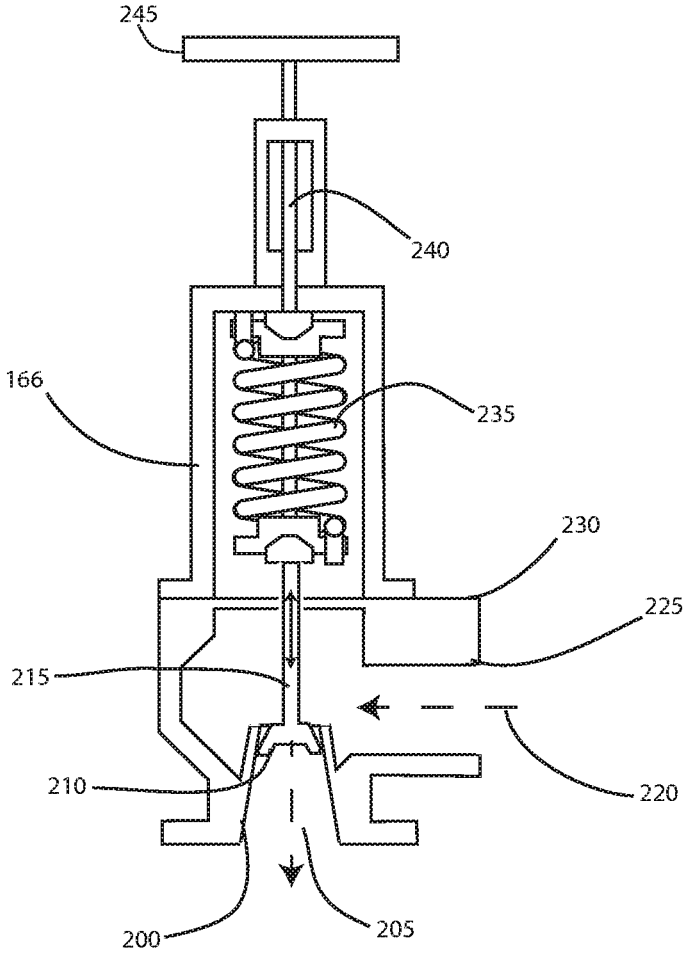
FIG. 21 is a schematic view of a pressure relief valve for an exemplary diaphragm pumping mechanism according to principles of the invention.

The vacuum relief valve 166 (i.e., check valve), fluidly coupled to the inlet 160, controls or limits the vacuum pressure in the system. A schematic of a non-limiting example of a vacuum relief valve 166 is provided in FIG. 21. Vacuum pressure is relieved by allowing ambient air 220 to flow into the inlet from an auxiliary passage 225 of the flow housing 230 of the valve 166. The exemplary relief valve 166 is designed or set with a spring 235 that holds a shank and a valve seat 210 against port 200, preventing fluid flow 205 therethrough. In the exemplary embodiment illustrated, the spring 235 is a tension spring that draws the valve seat 210 against the port 200. However a biasing mechanism other than a tension spring may be utilized without departing from the scope of the invention. The spring 235 allows the valve seat to open at a predetermined set pressure (i.e., negative pressure at the port 200). When the set pressure is exceeded, i.e., when the negative pressure is sufficient to unseat the valve seat, the relief valve becomes a "path of least resistance" as the valve seat 210 is forced open and fluid 220 is sucked in through the auxiliary route 225. The drawn-in fluid 220 (i.e., air) flows into the pump chamber. As the fluid 220 enters, the negative pressure inside the inlet 160 and pumping system 120 will be relieved. Once it reaches the valve's reseating vacuum pressure, the valve seat 210 will close.

The vacuum pressure gauge 165 measures the vacuum pressure (i.e., negative pressure or vacuum) at the inlet 160 through which fluid is sucked into the pumping mechanism 120. By way of example and not limitation, the gauge may comprise an aneroid gauge, such as a bourdon, diaphragm or bellows pressure gauge, or an electronic pressure sensor such as a piezoresistive, capacitive, inductance, piezoelectric, optical or potentiometric sensor. The purpose of the gauge is to indicate operating vacuum pressure and excessive pressure. Operating pressure evidences normal operation. A vacuum pressure spike indicates a blockage. An upstream blockage causes a high negative pressure.

A shaft 240 and handle 245 allow a user to manually open the valve seat 210 to relieve vacuum pressure. Manual release is particularly beneficial if a valve is malfunctioning and does not open when a blockage causing a vacuum pressure spike is experienced, and/or if the valve set pressure is excessive for the system, and/or to test responsiveness of the valve or pressure gauge, and/or to relieve pressure to facilitate clearing of a partial blockage that is insufficient to open the valve.

In FIGS. 2 and 7-9, the offset relationship of the push rods 125, 130 is apparent. One push rod 125 is in a raised (suction) position, while the other push rod 130 is in the lowered (compression) position. The raised push rod 125 and its corresponding diaphragm 190 draw fluid into the corresponding diaphragm chamber, while the lowered push rod 130 and corresponding diaphragm 195 expel fluid from the corresponding diaphragm chamber. As the eccentrics rotate 180°, the raised push rod 125 moves to a lowered position and the lowered pushrod 130 moves to a raised position. In each case, the raised pushrod causes its diaphragm to draw fluid into the corresponding diaphragm chamber, while the lowered pushrod causes its diaphragm to expel fluid from its diaphragm.

Figure 16:
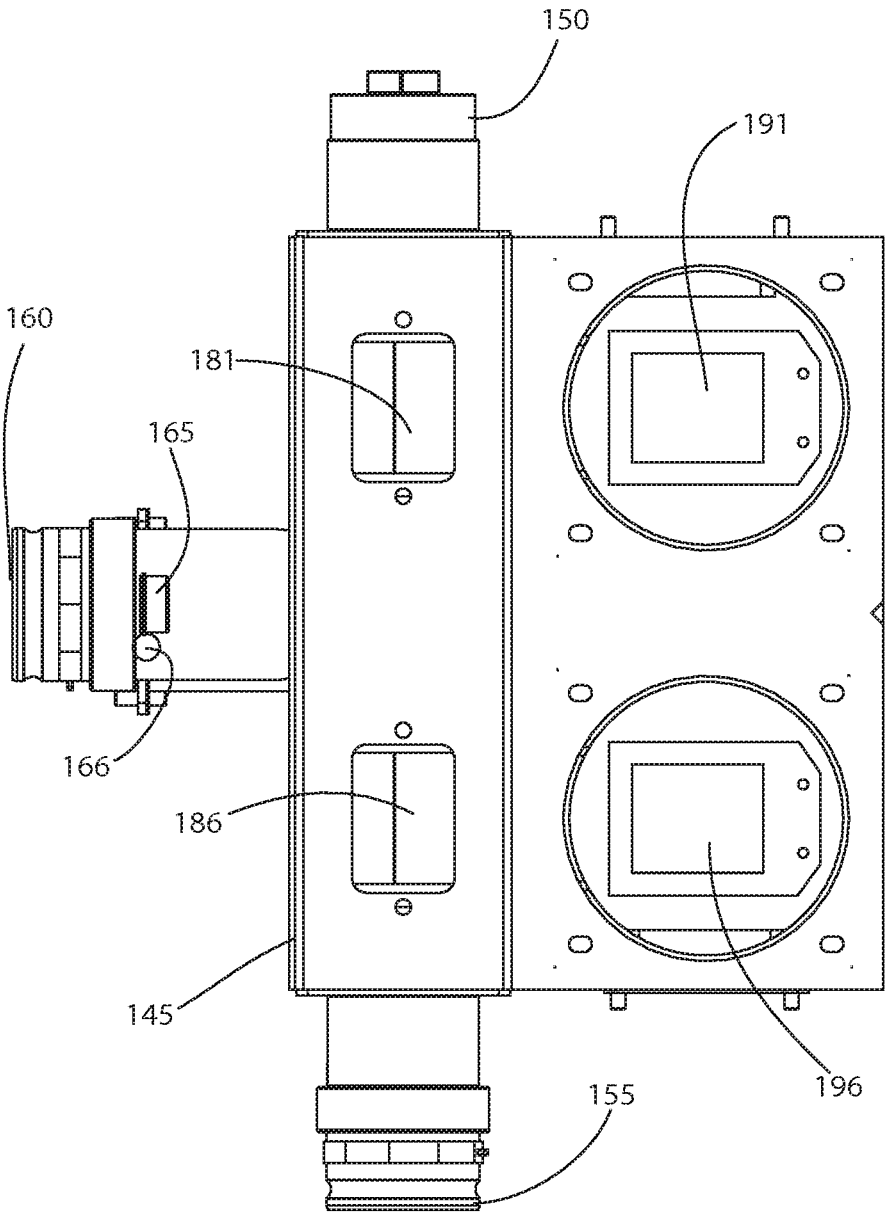
FIG. 16 is a plan view of chambers of an exemplary diaphragm pumping mechanism according to principles of the invention.
Figure 17:
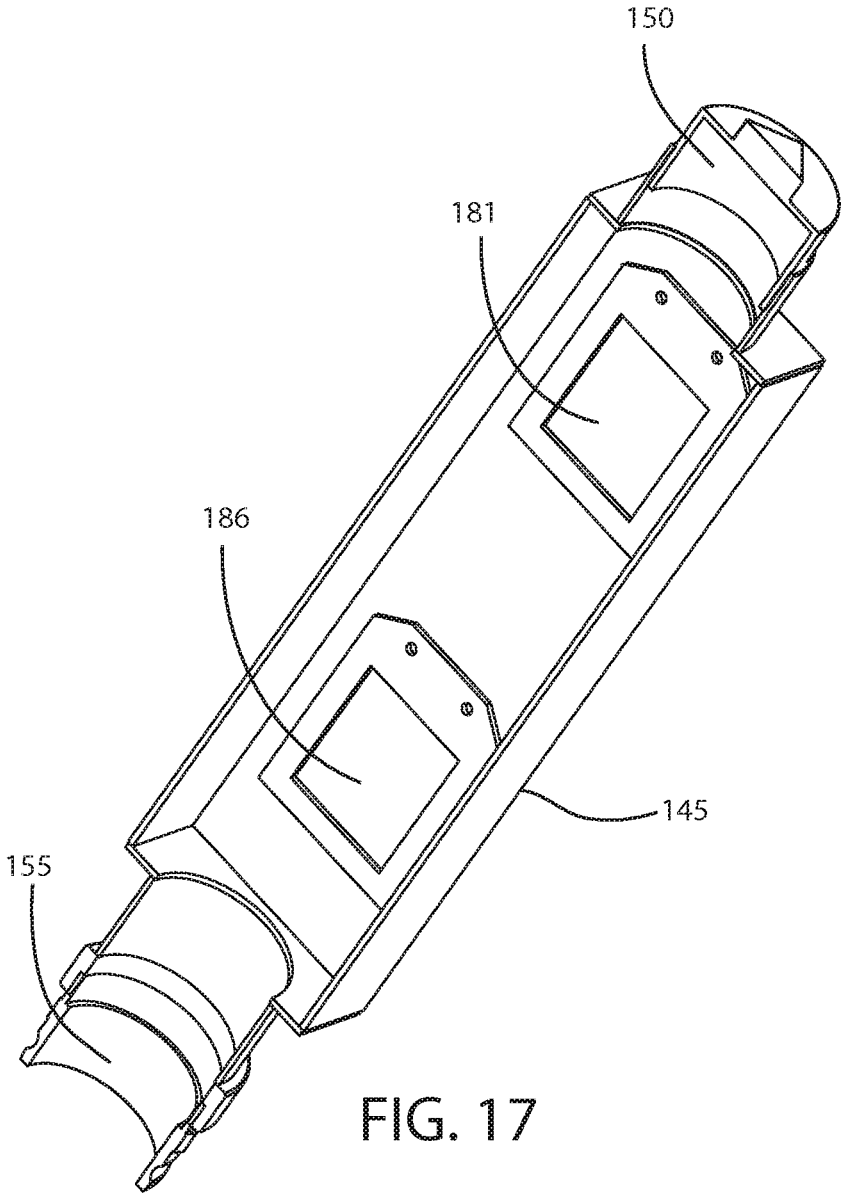
FIG. 17 is a perspective cutaway view of an outlet chamber of an exemplary diaphragm pumping mechanism according to principles of the invention.
Figure 18:
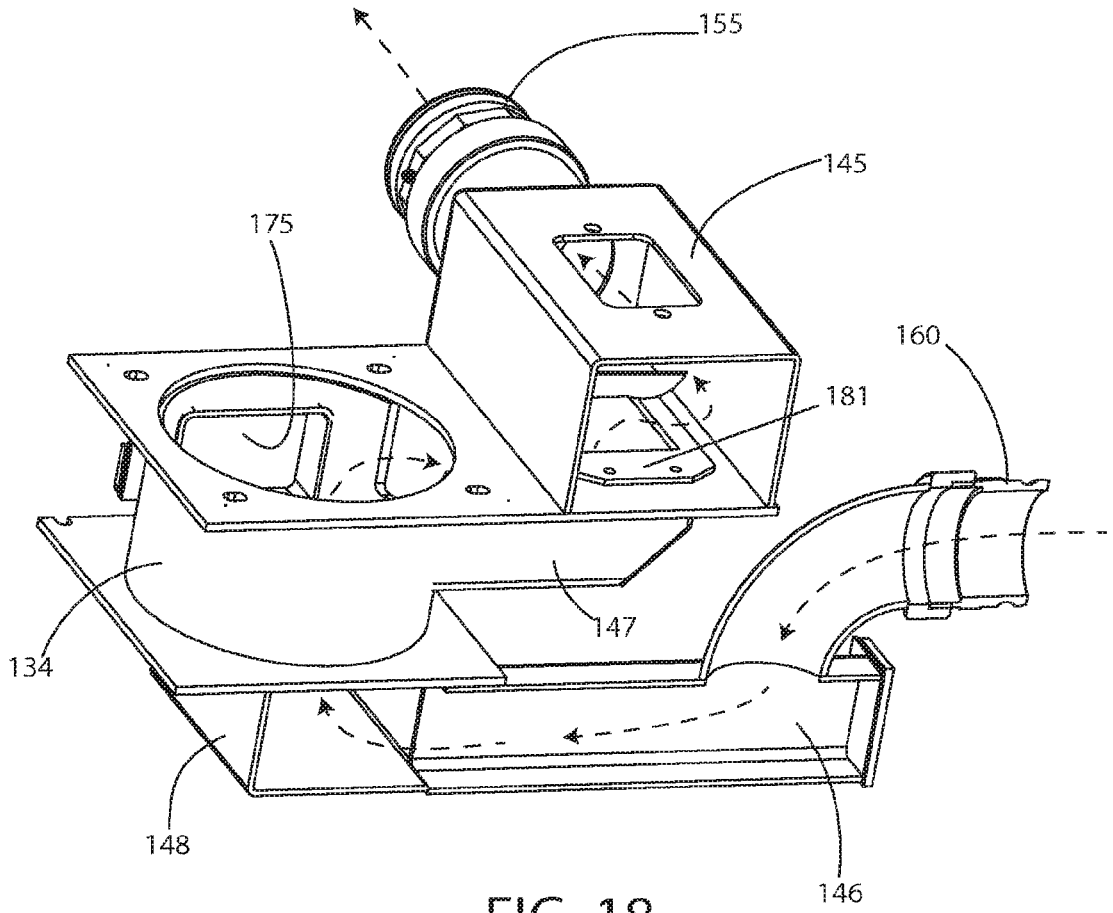
FIG. 18 is a perspective cutaway view of an inlet chamber of an exemplary diaphragm pumping mechanism according to principles of the invention.

FIGS. 16 and 17 illustrate valve locations. Outlet valves 181, 186 are located at the bottom surface of the outlet manifold 145. Each outlet valve is in fluid communication with a diaphragm chamber 129, 134. Each outlet valve opens 181, 186 when fluid is expelled from the outlet chamber 129, 134. Each outlet valve 181, 186 is urged closed by negative pressure in the corresponding diaphragm chamber 129, 134 when the pushrod 125, 130 for the corresponding diaphragm 190, 195 is in the raised position. Each outlet valve 181, 186 is drawn open from pressure in the corresponding diaphragm chamber 129, 134 when the pushrod 125, 130 for the corresponding diaphragm 190, 195 is in the lowered position. When the outlet valve opens, fluid flows from the corresponding diaphragm chamber 129, 134 through a corresponding outlet passage 147, 149, through the corresponding outlet valve 181, 186, into the outlet manifold 145, where it may exit through whichever outlet 150, 155 is open. The outlet passages 147, 149, that connect each diaphragm chambers 129, 134 to the outlet manifold 145 are clearly shown in FIGS. 10 and 13. Each passage connects one diaphragm chamber to the outlet manifold 145. During normal operation, only one outlet valve 181, 186 is open at a time. The open valve 181, 186 allows fluid flow from the corresponding passage 147, 149 into the manifold 145. The closed valve 181, 186 prevents fluid flow from the manifold 145 into the passage 147, 149 served by the closed valve 181, 186.

Inlet valves 191, 196 are located at the bottom surface of each diaphragm chamber. Each inlet valve is in fluid communication with a diaphragm chamber 129, 134. An inlet valve 191, 196 opens when fluid is drawn into the corresponding diaphragm chamber 129, 134. Each inlet valve 191, 196 is urged closed by pressure in the corresponding diaphragm chamber 129, 134 when the pushrod 125, 130 for the corresponding diaphragm 190, 195 is in the lowered position. Each inlet valve 191, 196 is drawn open by negative pressure in the corresponding diaphragm chamber 129, 134 when the pushrod 125, 130 for the corresponding diaphragm 190, 195 is in the raised position. When the inlet valve opens, fluid flows from the inlet 160 through inlet passage 146, into the inlet manifold 148, which is below each diaphragm chamber 129, 134, through whichever valve 191, 196 is open, and into the corresponding diaphragm chamber 129, 134. The inlet passages 146, that connects the inlet 160 to the inlet manifold 148 is clearly shown in FIGS. 10 and 13. During normal operation, only one inlet valve 191, 196 is open at a time. The open valve 191, 196 allows fluid flow from the inlet manifold 148 into the diaphragm chamber 129, 134 served by the open valve 191, 196. The closed valve 191, 196 prevents fluid flow from the inlet manifold 148 into the diaphragm chamber 129, 134 served by the open valve 191, 196.

The valves operate 180° apart in a 360° cycle. An inlet valve 191, 196 for a diaphragm chamber 129, 134 is never opened, during normal operation, when the outlet valve 181, 186 corresponding to the diaphragm chamber 129, 134 is opened. An inlet valve 191, 196 for a diaphragm chamber 129, 134 is never opened, during normal operation, when the other inlet valve 191, 196 is opened. Concomitantly, an outlet valve 181, 186 for a diaphragm chamber 129, 134 is never opened, during normal operation, when the other outlet valve 181, 186 is opened. Likewise, an outlet valve 181, 186 for a diaphragm chamber 129, 134 is never opened, during normal operation, when the inlet valve 191, 196 corresponding to the diaphragm chamber 129, 134 is opened. In sum, during normal operation, only one inlet valve is opened at a time, and only one outlet valve is opened at a time, and when an outlet valve for one diaphragm chamber is open, the inlet valve for the other diaphragm chamber is open, and an inlet valve only opens when the pushrod for the diaphragm for a chamber is in the raised position, and an outlet valve only opens when the pushrod for the diaphragm for a chamber is in the lowered position.

Figure 22:
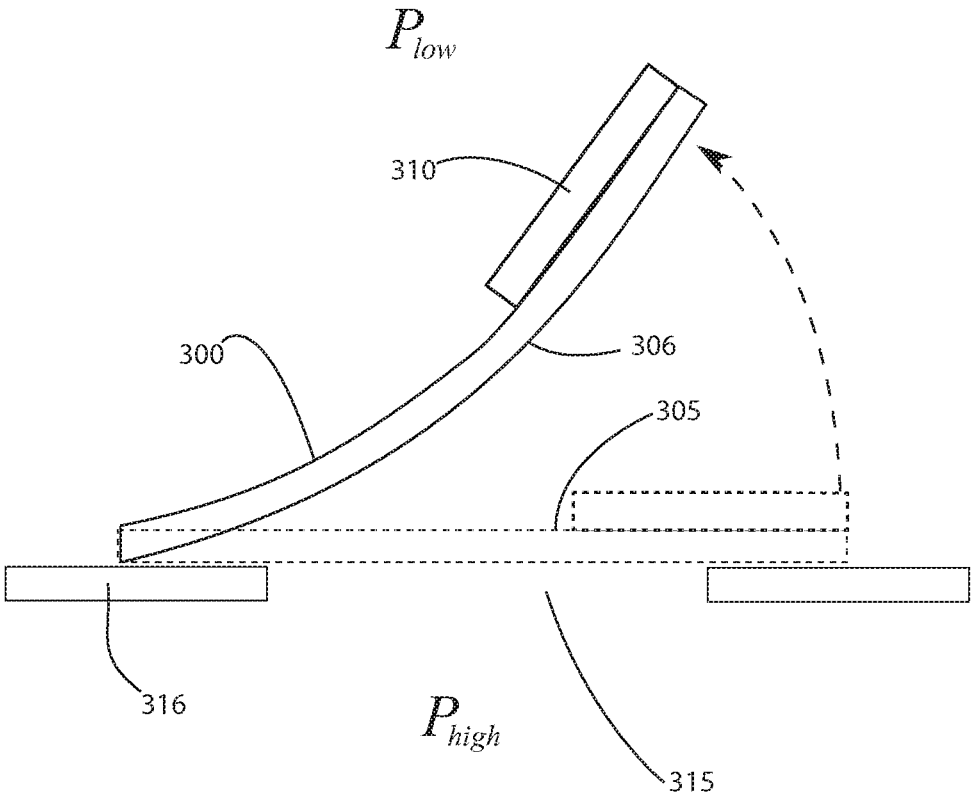
FIG. 22 is a schematic of a flapper valve for an exemplary diaphragm pumping mechanism according to principles of the invention.
Figure 23:
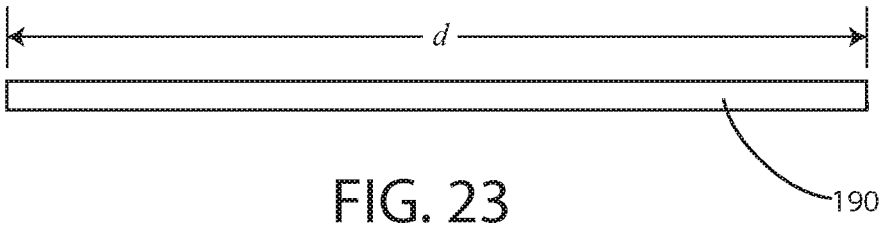
FIG. 23 is a profile view of an exemplary diaphragm, in an un-deformed state, for an exemplary diaphragm pumping mechanism according to principles of the invention.
Figure 24:
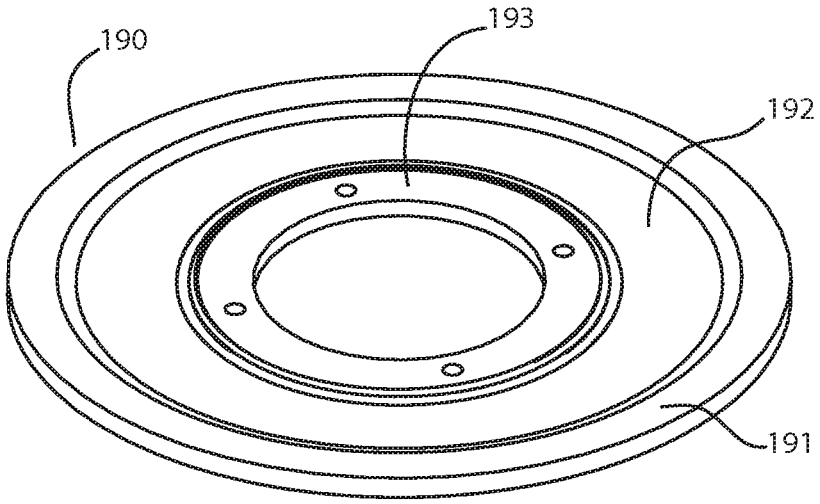
FIG. 24 is a perspective view of an exemplary diaphragm, in an un-deformed state, for an exemplary diaphragm pumping mechanism according to principles of the invention.
Figure 25:
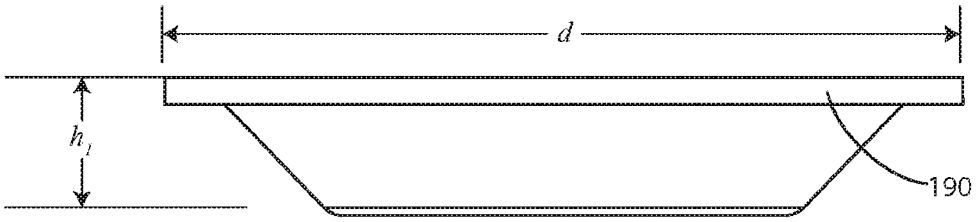
FIG. 25 is a profile view of an exemplary diaphragm, in a flexed downwardly state for expelling fluid, for an exemplary diaphragm pumping mechanism according to principles of the invention.
Figure 26:
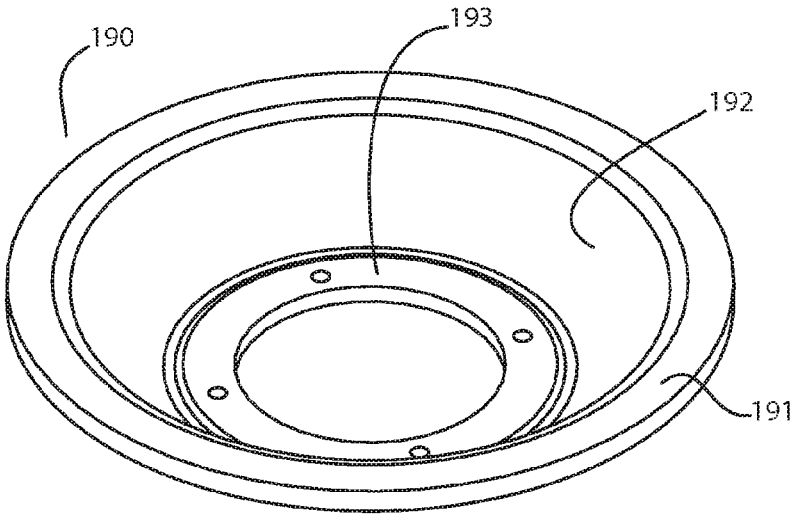
FIG. 26 is a perspective view of an exemplary diaphragm, in a flexed downwardly state for expelling fluid, for an exemplary diaphragm pumping mechanism according to principles of the invention.
Figure 27:
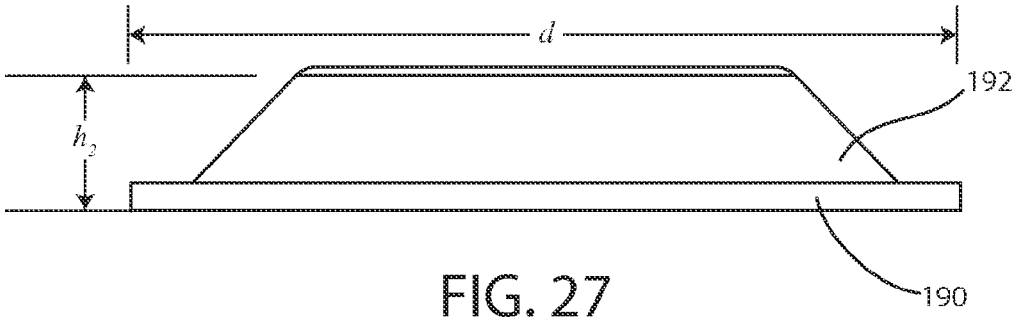
FIG. 27 is a profile view of an exemplary diaphragm, in a flexed upwardly state for drawing in fluid, for an exemplary diaphragm pumping mechanism according to principles of the invention.
Figure 28:
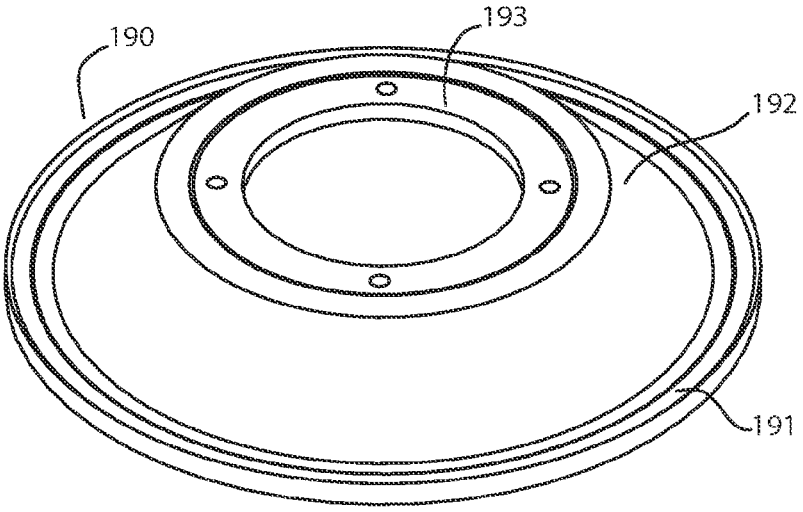
FIG. 28 is a perspective view of an exemplary diaphragm, in a flexed upwardly state for drawing in fluid, for an exemplary diaphragm pumping mechanism according to principles of the invention.
Figure 30:
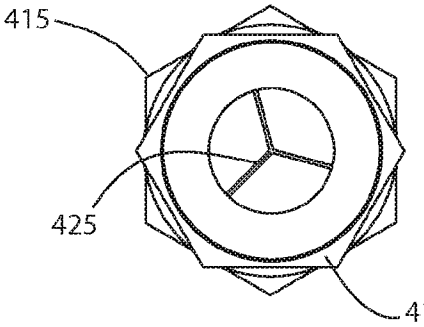
FIG. 30 is a plan view of an exemplary adjustable vacuum relief valve for an exemplary diaphragm pumping mechanism according to principles of the invention.
Figure 29:
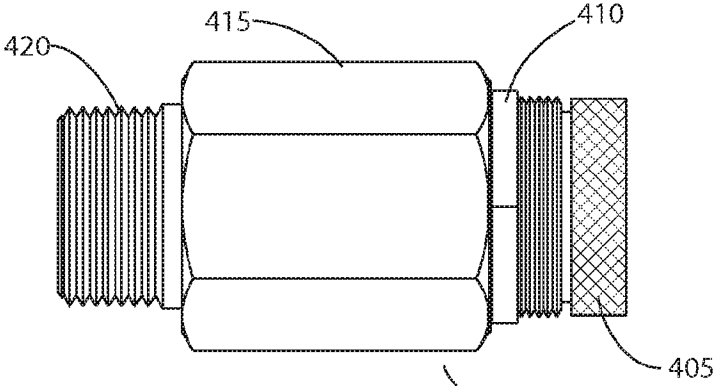
FIG. 29 is a profile view of an exemplary adjustable vacuum relief valve for an exemplary diaphragm pumping mechanism according to principles of the invention.
Figure 31:
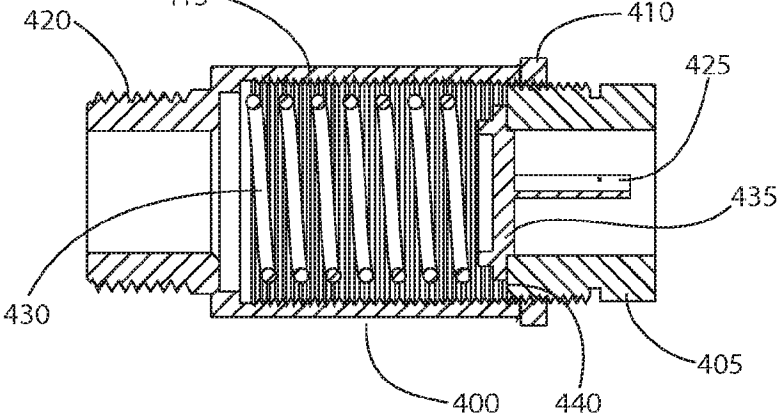
FIG. 31 is a cutaway view of an exemplary adjustable vacuum relief valve for an exemplary diaphragm pumping mechanism according to principles of the invention.
Figure 32:
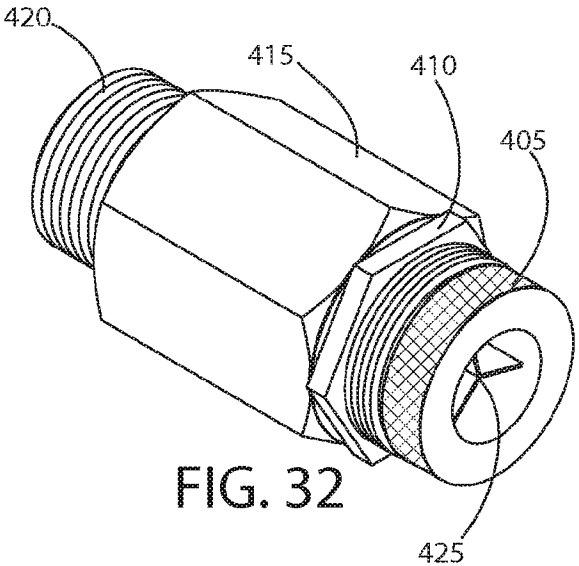
FIG. 32 is a perspective view of an exemplary adjustable vacuum relief valve for an exemplary diaphragm pumping mechanism according to principles of the invention.

While the invention is not limited to a particular valve design and various one way valves may be utilized, in a preferred embodiment, flap valves are used, as schematically illustrated in FIG. 22. Each flap valve is oriented over an opening 315 (i.e., port through which fluid may flow) in a horizontal wall of a flow path. The valve includes a resilient elastomeric valve body 300 attached at or near one edge to a horizontal base 316 through which the port 315 is formed. All other edges of the valve body 300 are not attached to the base 316. The valve body 300 covers the entire port 315 when the valve body is in the closed position 305. To assist closure without appreciably impairing opening, a weight 310 may be attached to the valve body 300. The weight may be from 4-16 ounces, depending upon the size of the port 315, mass of the valve body 300 and fluid pressures. The valve body 300 bends and its unattached edges deflect away from the port 315 when in an open position 306. In the open position 306, fluid may flow through the port 315. In the closed position 305, the resilient properties of the valve body 300 and gravity cause the valve body to return to the closed position 305, thereby preventing flow through the port 315.

FIGS. 29-32 conceptually illustrate another exemplary adjustable vacuum relief valve 400 for an exemplary diaphragm pumping mechanism according to principles of the invention. The valve 400 is threaded into the inlet 160. The valve 400 includes a threaded neck 420, e.g., a neck with NPT tapered threads, that threads into a threaded female port in the inlet 160. A hollow housing 415 with a hexagonal periphery contains a spring 430, valve body 435 and valve seat 440. The spring 430 urges the valve body 435 against the valve seat 440. A vacuum in the inlet 160 draws the valve body 435 away from the valve seat 440. Fins 425 guide movement of the valve body 435. A knurled threaded sleeve 405 defines the valve seat 440 and amount of spring 430 compression. Threading the sleeve 405 into the housing 430 increases compression of the spring 430, which increases the force exerted by the spring against the valve body 435, which increases the force by which the valve body 435 is held against the valve seat 440 in the closed (i.e. sealed) position. Conversely, threading the sleeve 405 in the opposite direction (i.e., out of the housing 430) decreases compression of the spring 430, which decreases the force exerted by the spring against the valve body 435, which decreases the force by which the valve body 435 is held against the valve seat 440 in the closed (i.e. sealed) position. If the pressure difference between ambient pressure and the pressure (vacuum) in the inlet 160 is sufficient to exert a force on the valve body 435 towards the threaded neck 420, then the valve body 435 will move away from the valve seat 440, breaking the seal and allowing ambient air to enter through the sleeve 405, which defines an auxiliary port for admitting air into the inlet when the valve is opened. Thus, the vacuum relief valve includes an opening through which ambient air may enter the inlet if pressure in the inlet 160 appreciably drops. Such a pressure drop may occur when a blockage impedes flow through a hose to the inlet 160. By admitting air through the valve 400, the risk of hose collapse and other potential damage is reduced.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

The invention claimed is:

1. A double diaphragm pump comprising:

a pair of diaphragm chambers, including a left diaphragm chamber and a right diaphragm chamber;

a pair of elastomeric diaphragms, including a left elastomeric diaphragm attached to the left diaphragm chamber, and a right elastomeric diaphragm attached to the right diaphragm chamber;

an eccentric for each of the pair of diaphragms, including a left eccentric aligned with and spaced apart from the left elastomeric diaphragm and a right eccentric aligned with and spaced apart from the right elastomeric diaphragm, the left eccentric rotating about an axis of rotation and the right eccentric rotating about the axis of rotation, and the left eccentric being oriented 180 degrees apart from the right eccentric;

a left pushrod coupling the left eccentric to the left elastomeric diaphragm and a right pushrod coupling the right eccentric to the right elastomeric diaphragm, rotation of the left eccentric about the axis of rotation causing reciprocating motion of the left pushrod and pumping motion of the left elastomeric diaphragm, and rotation of the right eccentric about the axis of rotation causing reciprocating motion of the right pushrod and pumping motion of the right elastomeric diaphragm, reciprocating motion of the left pushrod proceeding in a direction opposite the direction of reciprocating motion of the right pushrod;

a pair of inlet valves, including a left inlet valve for the left diaphragm chamber, and a right inlet valve for the right diaphragm chamber, each inlet valve comprising an inlet flap deflectable from a closed position to an open position, and in the closed position the inlet flap of the inlet valve being substantially horizontal and in the open position the inlet flap being deflected away from substantially horizontal;

a pair of outlet valves, including a left outlet valve for the left diaphragm chamber and a right outlet valve for the right diaphragm chamber, each outlet valve for each diaphragm being a flap valve, each outlet valve comprising an outlet flap deflectable from a closed position to an open position, and in the closed position the outlet flap of the outlet valve being substantially horizontal and in the open position the outlet flap being deflected away from substantially horizontal;

an inlet fluidly coupled to an inlet manifold, said inlet manifold being fluidly coupled to the pair of diaphragm chambers and each inlet valve being disposed in the inlet manifold, the left inlet valve being disposed between the left diaphragm chamber and the inlet, and the right inlet valve being disposed between the right diaphragm chamber and the inlet; and a relief valve fluidly coupled to the inlet, said relief valve including a valve mechanism comprising an auxiliary passage in fluid communication with the inlet, a valve body urged against a valve seat by a spring and blocking the auxiliary passage when the valve mechanism is closed, wherein the valve mechanism opens via linear displacement of the valve body away from the valve seat when a negative pressure at the inlet reaches a set pressure, and the auxiliary passage defining a conduit for ambient air flow into the inlet when said valve mechanism opens, said ambient air relieving pressure in the left diaphragm chamber and right diaphragm chamber and wherein the valve body comprises a rod having a manual actuator disposed at a first end and having a second end disposed in the auxiliary passage; and and an internal combustion engine with an output shaft, said output shaft rotating while the internal combustion engine runs, and said output shaft providing torque to simultaneously rotationally drive the left eccentric and the right eccentric.

2. The double diaphragm pump according to claim 1, further comprising a pressure gauge fluidly coupled to the inlet, said pressure gauge including a readable display indicating pressure within the inlet.

3. The double diaphragm pump according to claim 1, further comprising a gearbox, said engine including an output and said gearbox including one input and two outputs, including a left output and a right output, and a gear train coupling the one input of the gearbox to the two outputs of the gearbox, the output of the engine being coupled to the input of the gearbox and rotating at 1,500 to 2,500 rpm during operation, and each output of the gearbox rotating at 50 to 90 rpm during operation, and the outputs of the gearbox being aligned and defining the axis of rotation, and the left eccentric attached to left output of the gear box, and the right eccentric attached to right output of the gear box, and said left pushrod and right pushrod being driven in reciprocating motion by rotation of left eccentric and right eccentric about the axis of rotations, said reciprocating motion being between a first position closest to the diaphragm to which the pushrod is coupled, and a second position furthest from the diaphragm to which the pushrod is coupled, and reciprocating motion of the pushrods causing pumping motion of the diaphragms, including compression and suction motion of the diaphragms.

4. The double diaphragm pump according to claim 3, each eccentric being 180° apart, one pushrod being in a first position when the other pushrod is in a second position.

5. The double diaphragm pump according to claim 1, each of the pair of inlet valves comprising a one-way flap valve, said one-way flap valve including said inlet flap covering an opening in an inlet horizontal wall when closed and exposing said opening when opening, said inlet flap comprising a resilient material.

6. The double diaphragm pump according to claim 5, further comprising a weight on each inlet flap to facilitate closure.

7. The double diaphragm pump according to claim 5, said inlet flap comprising an elastomeric flap.

8. The double diaphragm pump according to claim 1, each of the pair of outlet valves comprising a one-way flap valve, said one-way flap valve including the outlet flap covering an opening in an outlet horizontal wall when closed and exposing said opening when opening.

9. The double diaphragm pump according to claim 8, further comprising a weight on each outlet flap to facilitate closure.

10. The double diaphragm pump according to claim 8, said outlet flap comprising an elastomeric flap.

11. The double diaphragm pump according to claim 1, further comprising a removable access panel over each of the pair of outlet valves, each access panel being removably secured with a plurality of bolts.

12. The double diaphragm pump according to claim 11, each access panel being removably secured with at least four bolts.

13. The double diaphragm pump according to claim 11, each access panel including a gasket for a fluid impervious seal.

14. The double diaphragm pump according to claim 1, further comprising a trailer for transportation.

15. The double diaphragm pump according to claim 1, the manual actuator allows for manually opening the valve mechanism.

16. The double diaphragm pump according to claim 1, the relief valve including an adjuster for regulating the set pressure.

17. The double diaphragm pump according to claim 1, the relief valve including a fluidly coupled pressure gauge, said pressure gauge being in fluid communication with the inlet.

* * * * *